US008353717B2

(12) United States Patent
Chadbourne

(10) Patent No.: US 8,353,717 B2
(45) Date of Patent: Jan. 15, 2013

(54) ELECTRICAL CONNECTOR WITH EXTERNAL GROOVES AND RIDGES

(75) Inventor: Christopher G. Chadbourne, Nashua, NH (US)

(73) Assignee: Hubbell Incorporated, Shelton, CT (US)

( * ) Notice: Subject to any disclaimer, the term of this patent is extended or adjusted under 35 U.S.C. 154(b) by 973 days.

(21) Appl. No.: 12/009,356

(22) Filed: Jan. 17, 2008

(65) Prior Publication Data

US 2009/0186518 A1 Jul. 23, 2009

(51) Int. Cl.
*H01R 4/24* (2006.01)

(52) U.S. Cl. ..... 439/411

(58) Field of Classification Search ..... 439/485, 439/411, 412, 800, 793, 791, 810, 877, 879, 439/811–814, 783, 797–798, 781–782
See application file for complete search history.

(56) References Cited

U.S. PATENT DOCUMENTS

| | | | | |
|---|---|---|---|---|
| 468,293 | A | 2/1892 | Coleman | 403/283 |
| 1,936,185 | A | 11/1933 | Brenizer | 173/263 |
| 2,375,741 | A | 5/1945 | Dibner | 29/148 |
| 2,490,809 | A | 12/1949 | Holke | 287/109 |
| 2,902,537 | A | 9/1959 | Salvi | 174/79 |
| 3,384,704 | A | 5/1968 | Vockroth | 174/90 |
| 3,475,545 | A | 10/1969 | Stark et al. | 174/88 |
| 3,681,512 | A | 8/1972 | Werner et al. | 174/84 |
| 3,735,331 | A | 5/1973 | O'Donnell et al. | 339/97 |
| 3,877,773 | A | 4/1975 | Doty et al. | 439/406 |
| 4,453,034 | A | 6/1984 | Annas et al. | 174/79 |
| 4,511,280 | A | 4/1985 | Saint-Prix et al. | 403/274 |
| 4,513,500 | A | 4/1985 | Knapp et al. | 29/885 |
| 5,616,036 | A * | 4/1997 | Polidori | 439/100 |
| 5,647,046 | A | 7/1997 | Cowen et al. | 385/136 |
| 5,975,948 | A | 11/1999 | Weaver | 439/578 |
| 6,015,953 | A | 1/2000 | Tosaka et al. | 174/79 |
| 6,056,605 | A | 5/2000 | Nguyen et al. | 439/882 |
| 6,287,145 | B1 * | 9/2001 | Goett | 439/579 |
| 6,805,596 | B2 | 10/2004 | Quesnel et al. | 439/877 |
| 6,875,045 | B1 * | 4/2005 | Hollick | 439/411 |
| 7,019,217 | B2 | 3/2006 | Bryant | 174/88 |
| 7,407,411 | B2 | 8/2008 | Byrne et al. | 439/578 |
| 2004/0132366 | A1 | 7/2004 | Hiel et al. | 442/43 |
| 2006/0084327 | A1 | 4/2006 | Chadbourne | 439/784 |
| 2006/0252309 | A1 | 11/2006 | Kodama et al. | 439/578 |

* cited by examiner

*Primary Examiner* — Edwin A Leon
(74) *Attorney, Agent, or Firm* — Harrington & Smith

(57) ABSTRACT

An electrical connector including a tube having a conductor receiving channel which is substantially closed except at one or more ends of the channel. The tube includes an exterior surface having longitudinal grooves and ridges along a longitudinal length the tube.

20 Claims, 5 Drawing Sheets

ELECTRICAL CONNECTOR WITH EXTERNAL GROOVES AND RIDGES

BACKGROUND OF THE INVENTION

1. Field of the Invention

The invention relates to an electrical connector and, more particularly, to an electrical connector with grooves and ridges.

2. Brief Description of Prior Developments

U.S. Pat. No. 2,375,741 discloses a splice electrical connector having a general tube shape with a bore having serrations along its length. U.S. Pat. No. 2,490,809 discloses a coil spring with knurling or milling on its inner and outer sides used in a splice electrical connector.

Prices for raw materials for making electrical connectors continues to be a difficulty in maintaining the cost-effective design of products used in the utility, construction, maintenance, and repair industries. With respect to electrical products fabricated from copper and aluminum, a tremendous surge in cost (per fabricated dollar of raw materials) has resulted in the development of measures to control cost of new designs fabricated from these materials. Also, there has been a wholesale change in using alternate alloys in the design of these products going forward. Further, the increased use of batteries as remote energy providers in many power tools, specifically battery powered crimping tools, has placed tremendous emphasis on the optimization of battery life to increase the functionality for the user.

There is a desire to reduce costs associated with the purchase of raw materials used to manufacture electrical connectors. In addition, there is also a desire to provide electrical connectors which require less energy to crimp with battery powered crimping tools and, therefore, help to prolong battery life of the crimping tool.

SUMMARY OF THE INVENTION

In accordance with one aspect of the invention, an electrical connector is provided including a tube having a conductor receiving channel which is substantially closed except at one or more ends of the channel. The tube includes an exterior surface having longitudinal grooves and ridges along a longitudinal length the tube.

In accordance with another aspect of the invention, an electrical connector is provided having a general tube shape with a conductor receiving channel. The channel is substantially closed except at opposite ends of the channel. An interior surface of the connector at the channel comprises longitudinal grooves and ridges along a longitudinal length of the connector. An exterior surface of the connector at the channel comprises longitudinal grooves and ridges along the longitudinal length of the connector.

In accordance with another aspect of the invention, a method of manufacturing an electrical connector comprising extruding a tube of metal having a conductor receiving channel which is closed except at opposite ends of the channel; and forming longitudinal grooves and ridges on an exterior surface of the tube along a longitudinal length of the tube.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
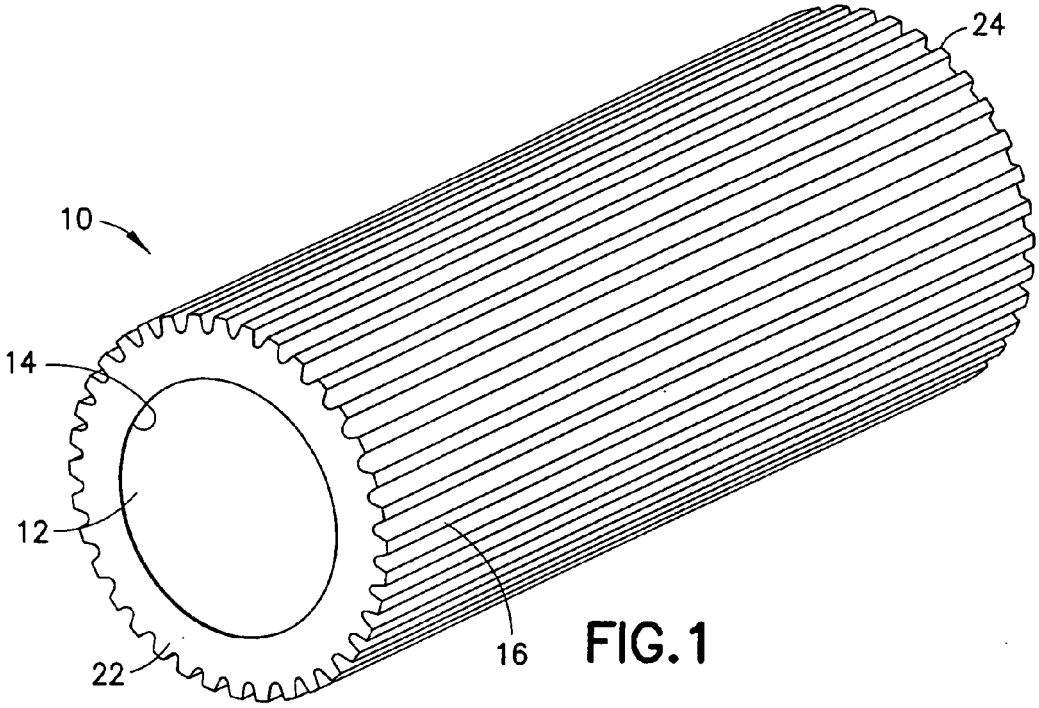
FIG. 1 is a perspective view of an electrical connector comprising features of the invention.

Referring to FIG. 1, there is shown a perspective view of a electrical connector 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The invention is particularly applicable to copper or aluminum tubular compression lugs, splices, and taps. The invention provides a novel approach to the design of these types of electrical connectors which optimizes material content; while at the same time providing for increased surface area in the 'finished' connection. This increases the ability of the connector to transfer energy, in the form of heat, to atmosphere more efficiently. This results in a cooler connection that will, therefore, result in an increased life expectancy. Further, this type of design would decrease the amount of time required to complete a crimping operation by a battery operated hydraulic crimping tool, thereby extending battery life of the tool.

Figure 2:
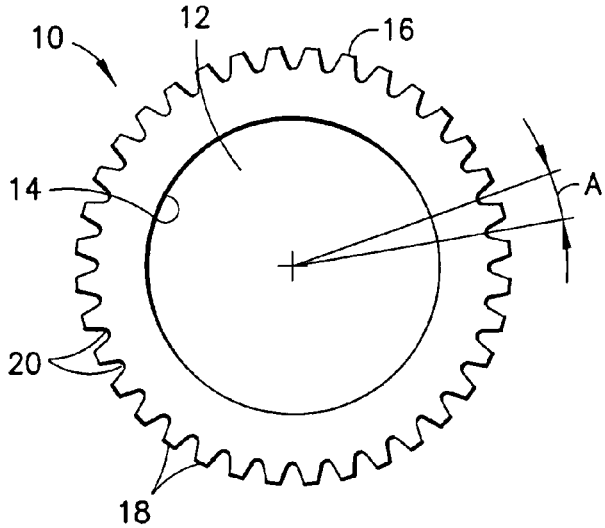
FIG. 2 is an end view of the connector shown in FIG. 1.

In the embodiment shown in FIG. 1, the electrical connector 10 comprises a splice connector adapted to connect two or more conductors to each other. The connector 10 comprises a one-piece metal member having a general tube shape. The interior channel 12 extends from front to rear, and forms a generally smooth inner diameter wall 14. Referring also to FIG. 2, the longitudinal exterior side 16 comprises a series of alternating ridges 18 and grooves 20. In this embodiment the ridges and grooves are straight and extend the entire length of the connector between the front end 22 and the rear end 24. However, in alternate embodiments the ridges and grooves might not be straight, and/or the ridges and grooves might not extend the entire length of the connector. In another alternate embodiment, rather than ridges and grooves, the exterior surface of the connector might comprise non-linear outward projections or inward depression pockets. In this embodiment the ridges and grooves are angled at an angle A of about 10 degrees. However, in alternate embodiments any suitable angle(s) could be provided. The inner and outer diameters of the connector 10 is the same as a conventional connector. However, the grooves 20 are provided on the outer surface. These grooves 20, in turn, form the ridges 18.

One purpose of the ridges 18 and grooves 20 is to provide a heat transfer surface on the exterior side 16 of the connector for heat transfer to the surrounding environment; such as surround air. Thus, the ridges 18 form heat transfer fins for this purpose. With the embodiment shown, one method of forming the connector 10 is by an extrusion process. During the extrusion process the ridges 18 and grooves 20 can be formed at the same time as the rest of the connector. This provides a very efficient and inexpensive method for forming the connector with an integral exterior side enhanced heat transfer system.

Another purpose of the ridges 18 and grooves 20 is to reduce the amount of material necessary to form the connector 10. More specifically, volumes of material are absent between the adjacent ridges 18 where the grooves 20 are now located. The connector 10 is still able to function as an electrical connector, but with use of less material to form the connector. Use of less material to form the connector 10, versus a similar conventional connector which does not have the grooves 20, allows the connector 10 to be manufactured less expensively than the conventional connector.

Figure 3:
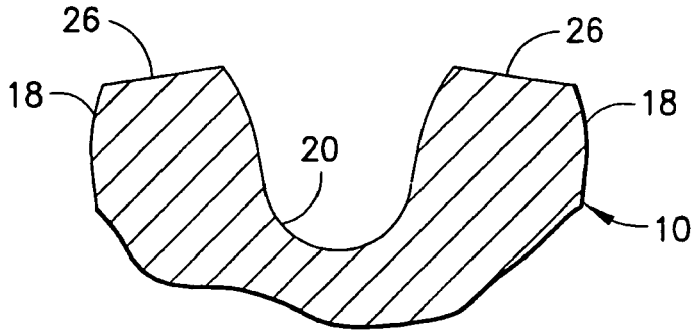
FIG. 3 is an enlarged cross sectional view of a portion of the connector shown in FIGS. 1 and 2.
Figure 4:
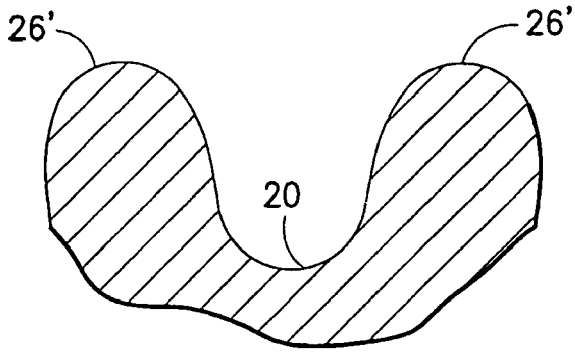
FIG. 4 is a cross sectional view similar to FIG. 3 of an alternate embodiment of the invention.
Figure 5:
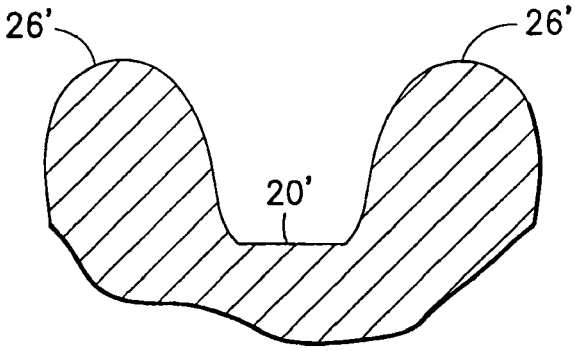
FIG. 5 is a cross sectional view similar to FIG. 3 of another alternate embodiment of the invention.

Referring also to FIG. 3, in this embodiment the ends or tips 26 of the ridges 18 are substantially flat. The grooves 20 are substantially curved. However, in alternate embodiments the shape of the tips of the ridges and the shape of the grooves could have any suitable type of shapes. For example, FIG. 4 shows an alternate embodiment with rounded tips 26' and a rounded groove 20, and FIG. 5 shows an alternate embodiment with rounded tips 26' and flat grooves 20'. Of course, cross sectional shapes other than round and flat could be provided.

Figure 6:
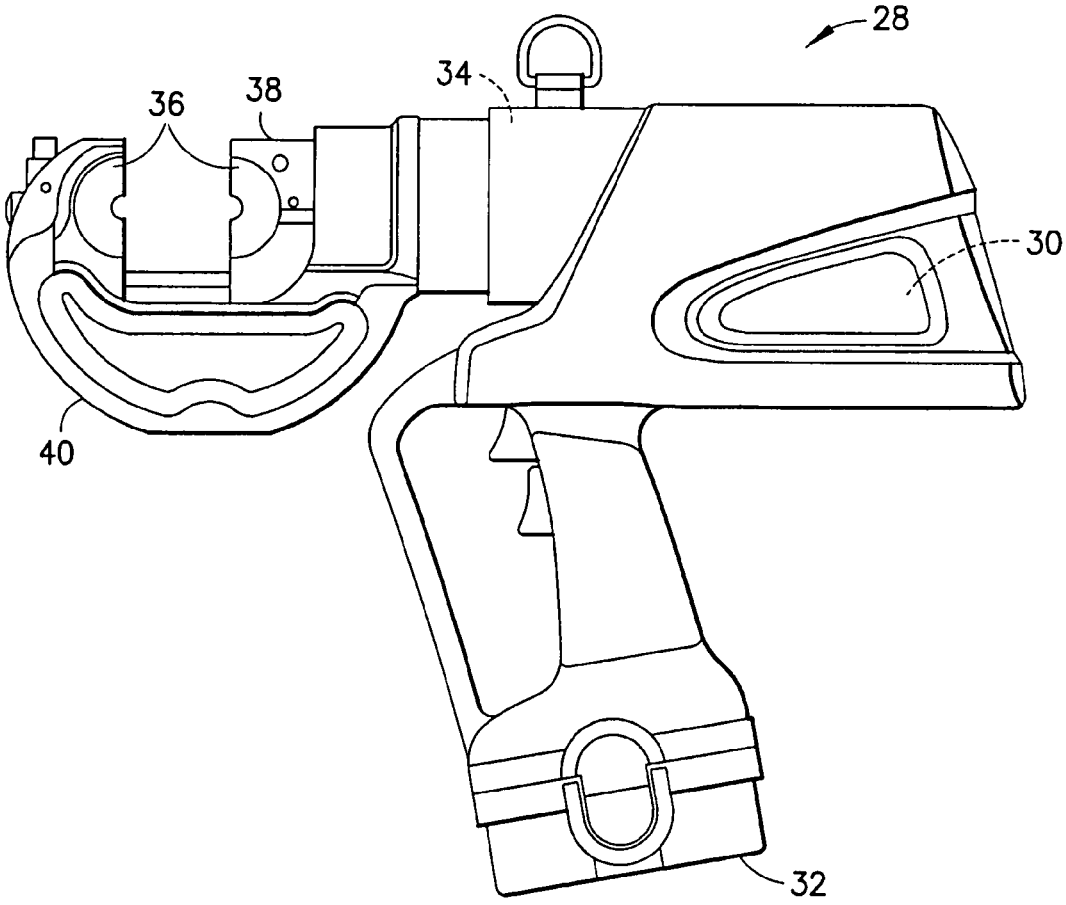
FIG.6 PRIOR ART
FIG. 6 is a side view of a conventional battery operated hydraulic crimping tool.

As noted above, the connector 10 is generally adapted to be compressed onto electrical conductors (not shown) to mechanically and electrically splice the conductors together. An example of a battery powered hydraulic crimping tool for this purpose is shown in FIG. 6. The tool 28 comprises an electric motor 30, a rechargeable battery 32, a hydraulic drive system 34 connected to the motor 30 by a transmission, and opposing crimping dies 36 connected to a ram 38 of the drive system 34 and an anvil section of the frame 40. The tool 28 is adapted to compress or crimp the connector 10 between the dies 36. However, in alternate embodiments any suitable type of crimping tool could be used.

In a preferred embodiment, the electrical connector has a rifled exterior (ridges and grooves) that would provide an average of about 17 percent additional surface area to the lug before crimping occurs. Of course, after the barrel of the connector is crimped by the tool 28, the rifling at the exterior (and/or interior) would not be that same percentage. However, an increase in surface area is still apparent; especially between crimps in the area of the connector exterior which was not crimped. Further, this design would allow the material to flow to its completely crimped state with less mechanical resistance since there is less overall material to deform; thereby decreasing the overall amount of time required to crimp the connector. For battery operated crimping tools used to crimp this type of connector, the decrease in crimping time would result in an increase in battery life per charge. So, not only does the connector shape optimize the material content and thermal characteristics of the product, but also the amount of time required to complete a crimping operation.

Figure 7:
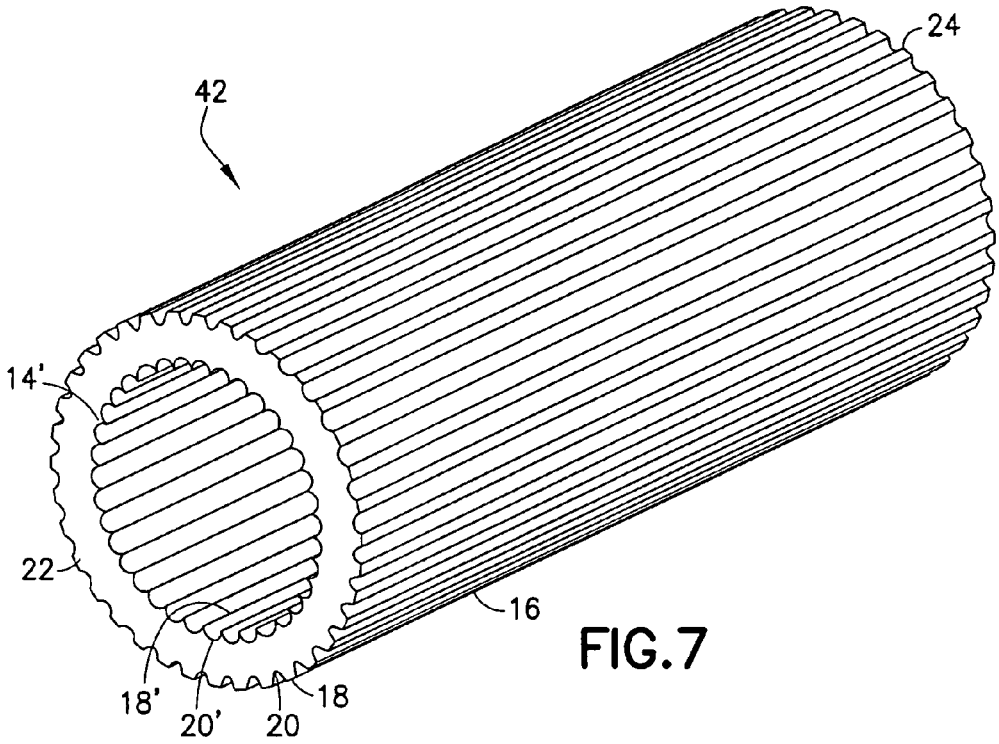
FIG. 7 is a perspective view of an alternate embodiment of an electrical connector comprising features of the invention.
Figure 8:
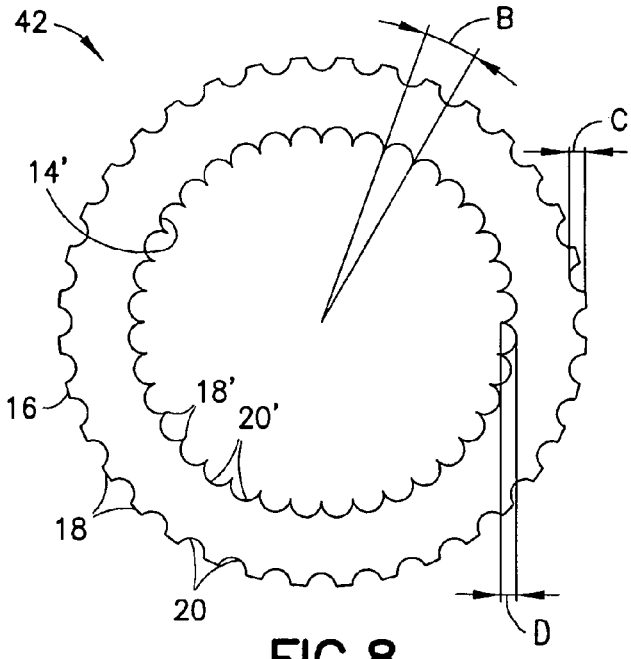
FIG. 8 is an end view of the connector shown in FIG. 7.

Alternate embodiments can be ascertained, such as rifled interior and exterior surfaces, interior only, and rifled in the form of various shapes and helical variations, and are apparent and included in the scope of this invention. One type of such alternate embodiment is shown in FIGS. 7 and 8. In this embodiment the electrical connector 42 is identical to the electrical connector 10 except of the surface 14' of the connector at the interior channel 12'. In this embodiment, the surface 14' comprises a series of alternating ridges 18' and grooves 20'. In this embodiment the ridges and grooves are straight and extend the entire length of the connector between front end 22 and the rear end 24. However, in alternate embodiments the interior ridges and grooves might not be straight, and/or the interior ridges and grooves might not extend the entire length of the connector. In another alternate embodiment, rather than interior ridges and grooves, the interior surface 14' of the connector might comprise non-linear inward projections. In this embodiment the interior ridges and grooves are angled at an angle B of about 10 degrees. However, in alternate embodiments any suitable angle(s) could be provided. In the embodiment shown, the connector is about 0.5 inch wide with the height C of the exterior ridges 18 is about 0.05 inch and the height D of the interior ridges 18' is about 0.05 inch. However, in alternate embodiments any suitable height could be provided.

The primary purpose of the interior rifling (ridges and grooves) is to use less material to form the connector 42; and thus make the connector less expensive to manufacture. However, the interior rifling also allows the reduced amount of material to flow to its completely crimped state with less mechanical resistance (since there is less overall material to deform); thereby decreasing the overall amount of time required to crimp the connector. For battery operated crimping tools used to crimp this type of connector, the decrease in crimping time would result in an increase in battery life per charge. So, not only does the connector shape optimize the material content and thermal characteristics of the product, but also the amount of time required to complete a crimping operation.

Figure 9:
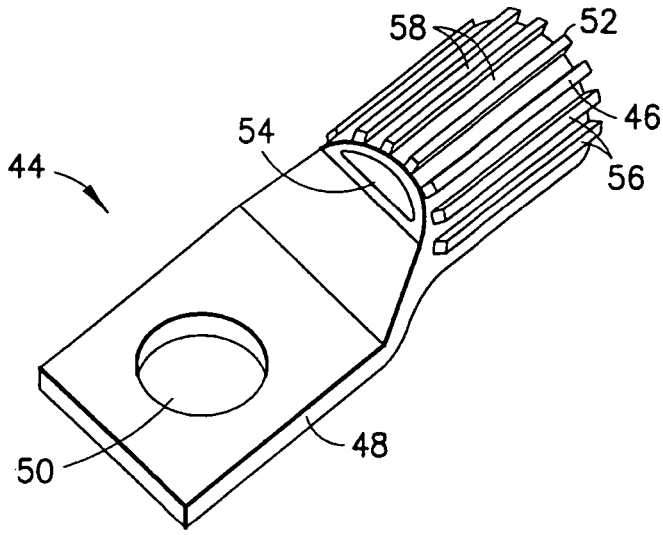
FIG. 9 is a perspective view of an alternate embodiment of the invention.

FIGS. 1 and 7 illustrate use of the invention with splice connectors. However, as noted above, the invention can also be used with other types of electrical connectors. FIG. 9 shows use of the invention with a lug electrical connector 44. The lug electrical connector 44 is comprised of a one-piece metal member. The connector 44 comprises a barrel section 46 and a lug section 48. The lug section 48 is a conventional lug section with a hole 50 adapted to be mounted on a post of another member. The barrel section 46 forms a tube adapted to receive an end of an electrical conductor. More specifically, a conductor receiving channel 54 extends into the rear end 52. The barrel section 46 can then be subsequently crimped onto the end of the conductor. The exterior surface of the barrel section 46 has a plurality of outwardly extending fins or ridges 56 and grooves 58.

These ridges 56 and grooves 58 are provided for the same reasons as the ridges 18 and grooves 20. In particular, the ridges 56 and grooves 58 allow less material to be used in order to form the connector 44; the missing material at the grooves 58 being less. The ridges 56 also form heat transfer fins. Although a portion of the barrel section 46 will be deformed during crimping, some portions of the ridges will still remain after crimping; such as in front of and behind the crimp location. The formation of the barrel section 46 having less material than a conventional lug connector also allows a battery operated crimping tool to crimp the barrel section 46 onto a conductor faster and with less resistance; thereby helping to prolong battery life of the crimping tool before recharging is necessary.

Figure 10:
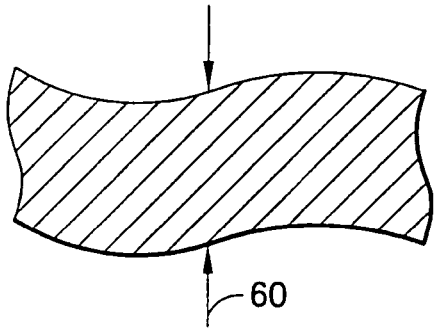
FIG. 10 is a cross sectional view of an alternate embodiment of the invention.
Figure 11:
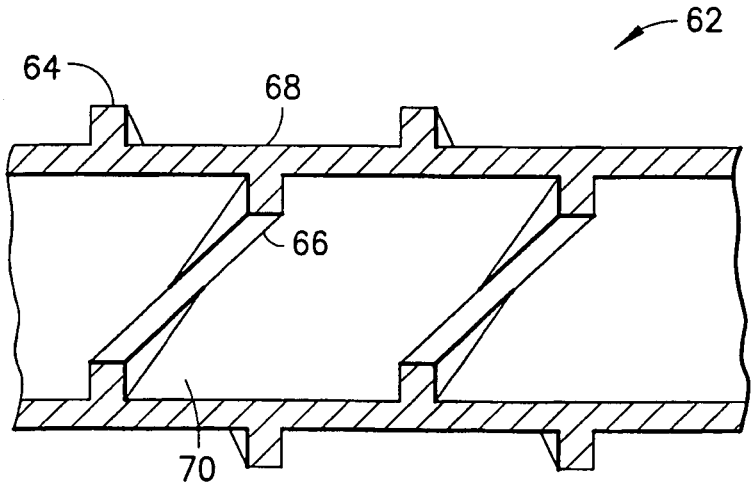
FIG. 11 is a partial cross sectional view of another alternate embodiment of the invention.

Referring now to FIG. 10, in another embodiment the electrical connector, such as the connectors in FIGS. 7 and 9, could be provided with a substantially uniform wall thickness 60 at their tube shapes with a wavy shape to provide the ridges and grooves. Referring to FIG. 11, another alternate embodiment is shown. In this embodiment the electrical connector 62 has internal and external ridges 64, 66 and grooves 68, 70.

However, the ridges and grooves have a helical shape along the length of the connector rather than a straight shape.

The development of 'rifled' (either helically or straight) tubing exteriors (and/or interiors) results in slightly less material by weight per connector, but would be a thermal heat sink and provide 'fins' in the form of grooves along the outer diameter of the connector for heat dissipation and material optimization. 'Rifling' the interior of the same lug would in fact result in material optimization, and may also allow the conductors inserted into the lug to form more contact spots with the inner diameter of the connector, thereby increasing electrical efficiency in the form of increased contact area.

It should be understood that the foregoing description is only illustrative of the invention. Various alternatives and modifications can be devised by those skilled in the art without departing from the invention. For example, features recited in the various dependent claims could be combined with each other in any suitable combination(s). Accordingly, the invention is intended to embrace all such alternatives, modifications and variances which fall within the scope of the appended claims.

What is claimed is:

1. An electrical splice connector comprising only a single one-piece member having a general tube shaped section with a conductor receiving channel, wherein the channel is substantially closed except at opposite ends of the channel, wherein an interior surface of the connector at the channel comprises longitudinal grooves and ridges along a longitudinal length of the connector, and wherein an exterior surface of the connector at the channel comprises longitudinal grooves and ridges along the longitudinal length of the connector to provide a reduced wall thickness of the general tube shaped section adapted to be crimped by a battery operated crimping tool with a reduced power drain on a battery of the tool.

2. An electrical connector as in claim 1 wherein the electrical connector comprises a single extruded metal member, wherein the longitudinal grooves and ridges on the exterior surface and the interior surface are integrally formed with the rest of the tube shaped section.

3. An electrical connector as in claim 1 wherein the longitudinal ridges on the exterior of the tube shaped section have flat or rounded tips.

4. An electrical connector as in claim 1 wherein the channel is entirely closed except at the opposite ends.

5. An electrical connector as in claim 1 wherein a thickness of a wall forming the tube shaped section between the exterior surface and the interior surface is substantially uniform along the length.

6. An electrical connector as in claim 1 wherein the longitudinal grooves and ridges on the interior surface and/or the exterior surface have a rifled shape.

7. An electrical connector as in claim 1 wherein the tube shaped section forms a first section adapted to be crimped onto a first electrical conductor, and the one-piece member comprises a second section adapted to be separately and independently crimped onto a second electrical conductor.

8. An electrical connector comprising only a single one-piece member having a tube shaped section having a conductor receiving channel which is substantially closed except at one or more ends of the channel, wherein the tube shaped section comprises an exterior surface having longitudinal grooves and ridges along a longitudinal length of the tube shaped section, and wherein the longitudinal grooves and ridges have a rifled shape.

9. An electrical connector comprising only a single one-piece member having a tube shaped section having a conductor receiving channel which is substantially closed except at one or more ends of the channel, wherein the tube shaped section comprises an exterior surface having longitudinal grooves and ridges along a longitudinal length of the tube shaped section, wherein the tube shaped section forms a barrel section and the one-piece member further comprises a lug section connected to the tube shaped section, and wherein the electrical connector is a lug electrical connector.

10. An electrical connector as in claim 1 wherein the tube shaped section forms a first section adapted to be crimped onto a first electrical conductor, and the one-piece member comprises a second section adapted to be separately and independantly crimped onto a second electrical conductor.

11. An electrical connector as in claim 8 wherein the electrical connector comprises a single extruded metal member, wherein the longitudinal grooves and ridges on the exterior surface are integrally formed with the tube shaped section.

12. An electrical connector as in claim 8 wherein the longitudinal ridges on the exterior of the tube shaped section have flat or rounded tips.

13. An electrical connector as in claim 8 wherein the at least one or more ends comprises two opposite ends of the tube shaped section.

14. An electrical connector as in claim 13 wherein the channel is entirely closed except at the two opposite ends.

15. An electrical connector as in claim 8 wherein an interior surface of the connector at the channel comprises longitudinal grooves and ridges along the longitudinal length of the connector.

16. An electrical connector as in claim 15 wherein a thickness of a wall forming the tube shaped section between the exterior surface and the interior surface is substantially uniform along the length.

17. An electrical connector as in claim 16 wherein the tube shaped section comprises an extruded metal member, wherein the longitudinal grooves and ridges on the exterior surface are integrally formed with the tube shaped section.

18. An electrical connector as in claim 17 wherein the longitudinal grooves and ridges on the exterior of the tube shaped section extend along an entire length of the tube shaped section.

19. An electrical connector as in claim 18 wherein the longitudinal ridges on the exterior of the tube shaped section have flat or rounded tips.

20. An electrical connector as in claim 8 wherein the tube shaped section forms a first section adapted to be connected to a first electrical conductor, and the one-piece member comprises a second section adapted to be separately and independently connected to a second electrical conductor.

* * * * *